US007287476B2

(12) United States Patent
Durbano

(10) Patent No.: US 7,287,476 B2
(45) Date of Patent: Oct. 30, 2007

(54) RAILROAD PANEL PLACEMENT SYSTEM

(75) Inventor: Ernest Bruce Durbano, Layton, UT (US)

(73) Assignee: Durbano Metals, Inc., Ogden, UT (US)

( * ) Notice: Subject to any disclaimer, the term of this patent is extended or adjusted under 35 U.S.C. 154(b) by 0 days.

(21) Appl. No.: 10/798,052

(22) Filed: Mar. 10, 2004

(65) Prior Publication Data

US 2005/0199153 A1 Sep. 15, 2005

(51) Int. Cl.
*E01B 29/05* (2006.01)

(52) U.S. Cl. ..... 104/2

(58) Field of Classification Search ..... 104/2, 104/4, 5, 7.1, 7.2, 12
See application file for complete search history.

(56) References Cited

U.S. PATENT DOCUMENTS

| | | | | |
|---|---|---|---|---|
| 1,972,583 A | | 9/1934 | Cullen | |
| 2,695,809 A | | 11/1954 | Hooker | |
| 2,841,434 A | | 7/1958 | Hooker et al. | |
| 2,920,465 A | | 1/1960 | Kaplan | |
| 2,945,608 A | | 7/1960 | Beler | |
| 2,945,609 A | | 7/1960 | Benes et al. | |
| 2,959,411 A | | 11/1960 | Kaplan | |
| 2,987,339 A | | 6/1961 | Kaplan et al. | |
| 3,153,555 A | | 10/1964 | Kaplan et al. | |
| 3,155,416 A | | 11/1964 | Buchik et al. | |
| 3,199,462 A | | 8/1965 | Hooker | |
| 3,220,720 A | | 11/1965 | Busch et al. | |
| 5,191,839 A | * | 3/1993 | Young et al. | 104/2 |
| 6,089,163 A | * | 7/2000 | Williams | 104/2 |
| 6,220,169 B1 | * | 4/2001 | Rosenquist et al. | 104/2 |
| 6,637,340 B1 | * | 10/2003 | Wilson | 104/2 |

FOREIGN PATENT DOCUMENTS

| | | | |
|---|---|---|---|
| CA | 645541 | 7/1962 | 294/17 |
| CA | 657669 | 2/1963 | 294/17 |
| CA | 718794 | 9/1965 | 294/17 |

OTHER PUBLICATIONS

The Panel Boss™ Instructions DVD, presenting instructions on use of Panel Boss (approximately 6 minutes).
The Panel Boss™ Demo DVD, demonstrating use of two devices: (1) a Burro Crane, Inc., device, available on information and belief prior to Mar. 2003 (first 3 minutes, approximately); and (2) the Panel Boss™ (remaining 7 minutes, approximately).

* cited by examiner

*Primary Examiner*—S. Joseph Morano
*Assistant Examiner*—Robert J. McCarry, Jr.

(57) ABSTRACT

A device and system for lifting and transporting a rail panel is disclosed. The rail panel includes a first and a second spaced apart rail attached to a plurality of ties. The system includes a frame and a plurality of hydraulically operated pins coupled to the frame. When the hydraulically operated pins are actuated, the frame is fixed to the first and second spaced apart rails. The system further includes a piece of equipment capable of lifting the frame while the frame is fixed to the rails.

43 Claims, 9 Drawing Sheets

RAILROAD PANEL PLACEMENT SYSTEM

BACKGROUND OF THE INVENTION

1. The Field of the Invention

Exemplary embodiments of the present invention relate to the laying or repairing of railroad tracks, and, more specifically, to a system for moving and placing railroad panels.

2. The Relevant Technology

Railroads and rail systems have existed since the middle of the nineteenth century. In a typical rail system, rail cars move along a pair of steel rails that are evenly spaced apart. These rails are secured to wooden ties that are laid in a bed of gravel or some other stabilizing material. This system of rails and ties is known as a railroad track.

Railroad tracks were originally laid down by a group of workers. The workers would manually set each individual tie on the rail bed. Once a sufficient number of ties had been laid, the workers would manually secure the steel rails to the ties. This was done by hammering large spikes into the ties at spaced apart intervals to hold down the rails. The process was very labor intensive, and potentially very dangerous. The ties and rails were quite heavy, and there was always the potential to drop one or both on, for example, a workers foot.

By the 1950's, railroad operators had devised a better system for laying and/or repairing railroad tracks. The operators started using rail panels to lay or repair track. A rail panel is made up of a pair of evenly spaced rails attached to a series of ties. In one standard configuration, the rail panel is 39 feet long and weighs approximately 10,000 pounds. The rails have joint bars on one end to allow the panel to be lined up with an existing section of track.

Modern railroad operators typically use a panel grabber that picks up a panel as a unit. The panel grabber allows a panel to be placed in position without having to individually lay ties and rails. Typical panel grabbers have a pair of arms that resemble two large pairs of pliers spaced about three feet apart. These pliers-like arms fit over the outside of the rails. The arms must be manually locked in place on the panel. As a lifting force is applied, the arms grab the sides of the rails, thus allowing the panel to be moved.

To use such typical panel grabbers, an individual must climb on top of a stack of panels to align the grabber. These stacks of panels are often delivered to a job site on the back of a flatbed truck. They can be stacked six or more high. Having been transported for potentially many miles, these stacks of panels may be unstable when tie downs securing the panels are released. An individual climbing on top of the panels must manually align the panel grabber, placing it very near the center of the panel, and then lock it in place. If the panel grabber is not placed near the center of the panel, it will lift only one end of the panel, causing the other end to tilt and/or drag. If it is not properly centered, the individual must climb back onto the stack of panels and manually attempt alignment a second time.

With the typical system, individuals with guide ropes generally manually stabilize the 10,000 pound panels when the panel is lifted and suspended in the air. This prevents the panel from twisting or turning in undesired orientations. Unfortunately, it is a challenge for an individual, or even a group of individuals, to exert enough force on a 10,000 pound panel to stabilize it while it is suspended in the air. Additionally, other individuals must physically align the joint bars with the existing track. This system can require as many as six men to place one panel onto the rail bed.

BRIEF SUMMARY OF THE EXEMPLARY EMBODIMENTS

It would therefore be an improvement in the art to develop a system of lifting, moving, and placing rail panels that eliminates, as much a possible, the need for manual labor in the process. Exemplary embodiments of the inventive system described herein allow a heavy equipment operator to attach a lifting device, lift the panel, and accurately place the panel adjacent to currently installed track without having multiple personnel attempting to manually stabilize and align the panels.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Reference will now be made to FIGS. 1-8 wherein like structures will be provided with like reference designations. It is to be understood that the figures are diagrammatic and schematic representations of an embodiment of the claimed invention, and are not to be construed as limiting the scope of the present invention in any way, nor are the figures necessarily drawn to scale.

Figure 1A:
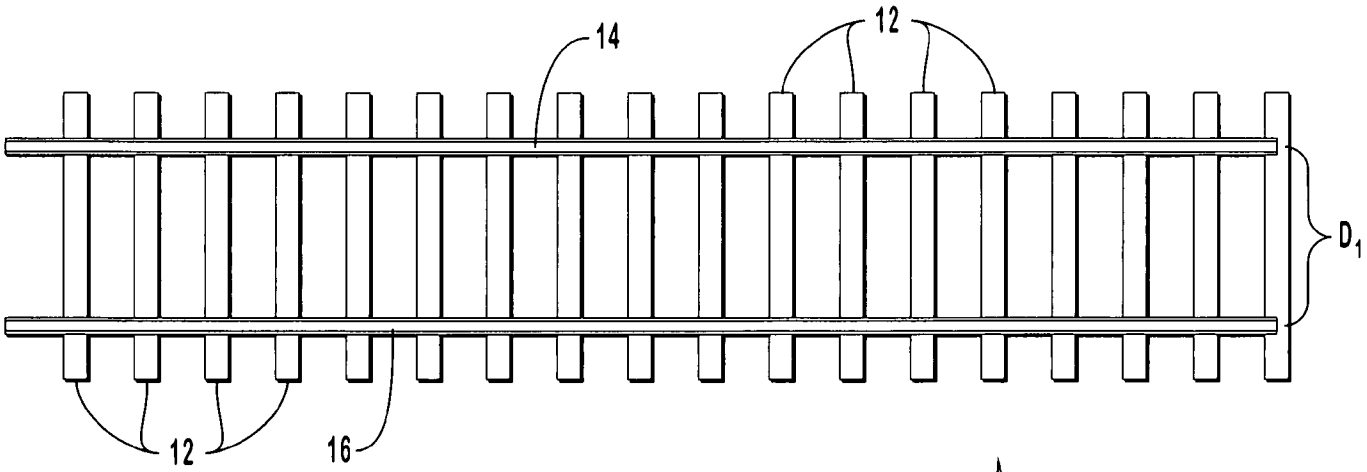
FIGS. 1A and 1B illustrate a top and end view, respectively, of an exemplary rail panel.
Figure 1B:
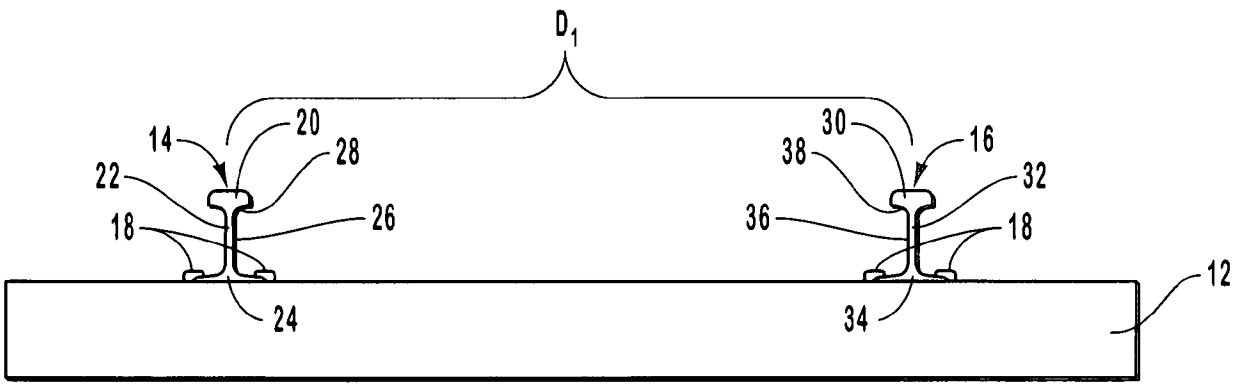

FIGS. 1A and 1B illustrate one exemplary rail panel 10. Rail panel 10 has a plurality of ties 12 supporting a left rail 14 and a right rail 16. In exemplary embodiments, rail panel 10 is approximately 39 feet long, approximately 8.5 feet wide, and weighs approximately 10,000 pounds. In some instances, a rail panel uses 24 ties, although rail panels can also use any number of ties or other connecting linkages. The distance $D_1$ between the inside vertical surfaces of rails 14, 16 is known as the gauge. It is set by various standards setting organizations around the world, and can be different in different countries. For example, in the U.S., the standard railroad gauge is 4 feet, 8.5 inches. However, this distance varies by country. Exemplary embodiments of the present invention can be specifically designed to work with any gauge track, whether currently in use somewhere in the world or later developed.

With specific reference to FIG. 1B, rails 14, 16 have a generally "I" shaped cross section that is slightly smaller on top that on bottom. A plurality of spikes 18 attaches rails 14, 16 to ties 12. Left rail 14 is composed of three parts, a head 20, a body 22, and a foot 24. Body 22 has an inside vertical surface 26. Head 20 has an inside lower surface 28. Similarly, right rail 16 is also composed of three parts, head 30, body 32 and foot 34. Body 32 has an inside vertical surface 36. Head 30 has an inside lower surface 38. These surfaces will be discussed in more detail below with reference to FIGS. 4A and 4B.

Figure 2:
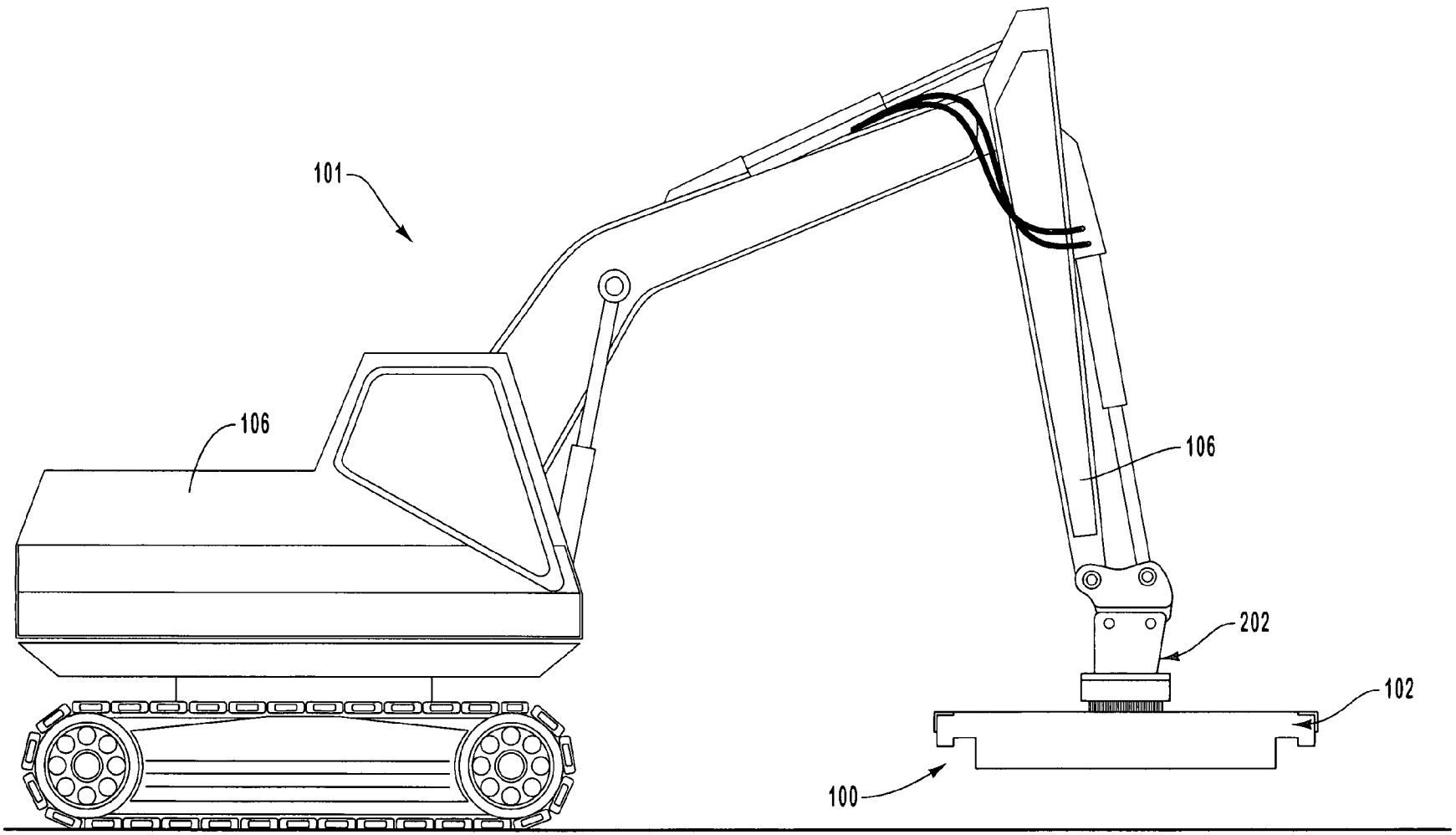
FIG. 2 illustrates a perspective view of a system for lifting and transporting a rail panel, the system comprising a rail panel grabber assembly, according to one aspect of the present invention.

FIGS. 2-8 illustrate one exemplary embodiment of a rail panel grabber assembly 100 according to one aspect of the present invention. With reference to FIG. 2, rail panel grabber assembly 100 includes a panel grabber 102 linked to a rotator 202. Specific details of panel grabber 102 and rotator 202 will be discussed below. Rail panel grabber assembly 100 can be linked to a hydraulic excavator 106, which is an example of a piece of equipment capable of lifting rail panel assembly 100 when it is attached to a rail panel. Excavator 106 and assembly 100 collectively serve as an example of a system for lifting and transporting a rail panel.

Excavator 106 can be any piece of equipment of sufficient size to manipulate rail panel grabber assembly 100 when it is holding rail panel 10. In exemplary embodiments, excavator 106 can have one or more quick couplers (not shown) to facilitate the easy coupling of the hydraulic lines that power rail grabber 102 and rotator 202. Such couplers are well known to those of skill in the art.

Figure 3:
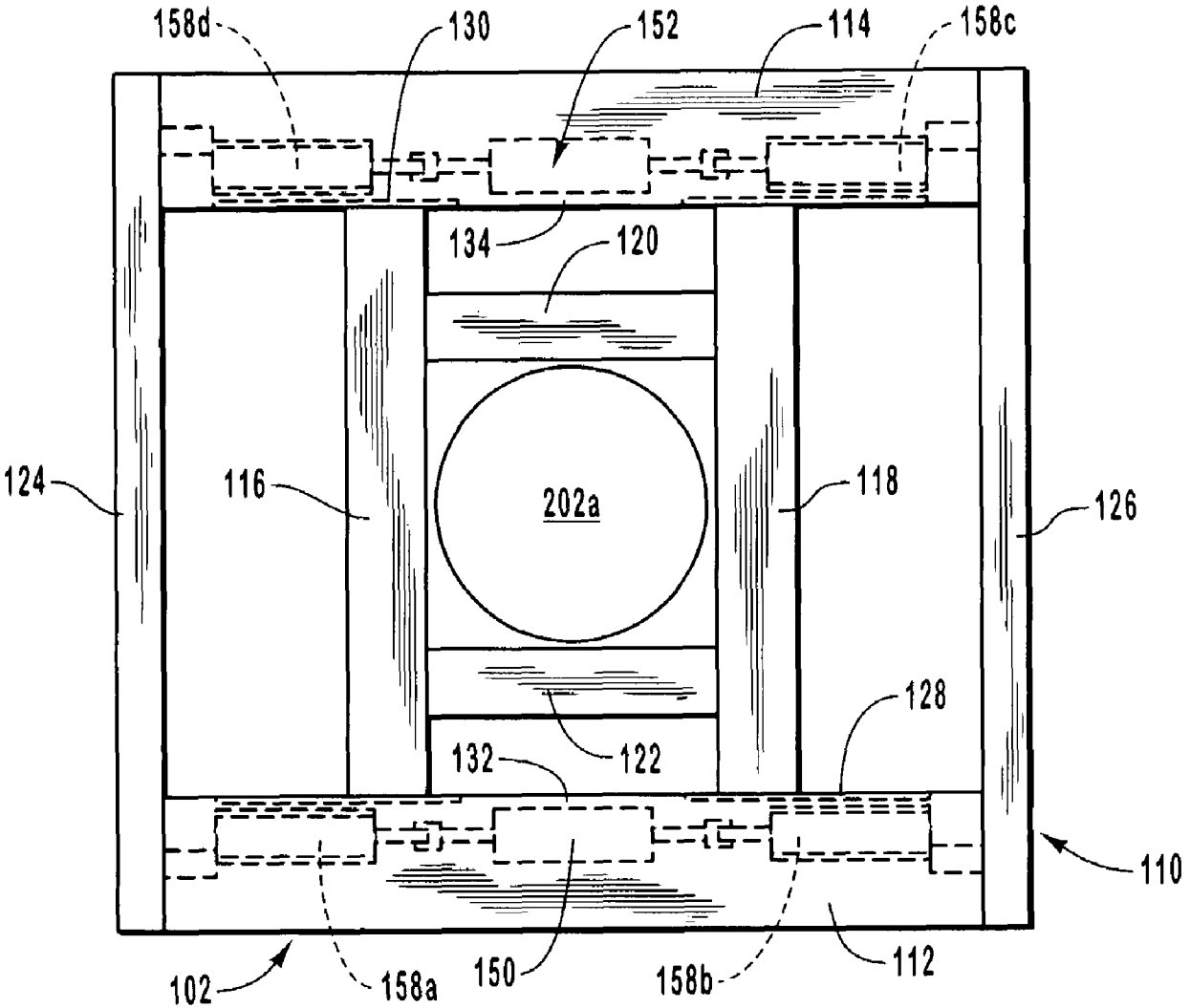
FIG. 3 is a top plan view of a panel grabber assembly of FIG. 2.

With general reference to FIGS. 3-8, and specific reference to FIG. 3, rail grabber 102 includes a frame 110. Frame 110 comprises first and second "H" beams 112, 114 spaced apart from each other. Linked between first and second "H" beams 112, 114 are first and second tubes 116, 118. In an exemplary embodiment, first and second tubes 116, 118 are perpendicular to first and second "H" beams 112, 114.

However, those skilled in the art will realize that other angles are possible and are included within the scope of exemplary embodiments of the invention.

To provide additional structural support to rotator 202, first and second tubes 116, 118 can have third and fourth tubes 120, 122 linked therebetween. In an exemplary embodiment, third and forth tubes 120, 122 are perpendicular to first and second tubes 116, 118. However, those skilled in the art will realize that other angles and structures are possible and are included within the scope of exemplary embodiments of the invention. In this exemplary embodiment, tubes 116, 118, 120, 122 define the perimeter of a rotator attachment area 202*a* on panel grabber 102. Finally, to provide additional structural support to "H" beams 112, 114, of frame 110, a first and second angle brace 124, 126 can be fixed to the outer portions of first and second "H" beams 112, 114.

In exemplary embodiments, first and second "H" beams 112, 114, first, second, third, and fourth tubes 116, 118, 120, and 122, respectively, and first and second angle braces 124, 126 are made from metal. Specifically, by way of example and not limitation, these frame members can be made from iron, steel or various metal alloys known to those of skill in the art. In one exemplary embodiment (shown in FIG. 5), first and second "H" beams measure 10 by 10 inches and comprise ½ inch thick top and bottom flanges 112*a*, 112*b*, 114*a*, 114*b*, respectively, with a 5/16 inch web 112*c*, 114*c* centered perpendicularly therebetween. Other dimensions and thicknesses are also possible. Additionally, other cross-sectional structures can be used to include, by way of example and not limitation, square, rectangular, circular, oval, or any other cross section capable of providing sufficient structural rigidity to support the weight of rail panel 10 while it is being manipulated by excavator 106.

With continued reference to FIG. 3, in exemplary embodiments, tubes 116, 118 comprise 6" wide by 10" tall tubes having a generally rectangular cross section and an approximately ⅜ inch wall thickness. Tubes 120, 122 comprise 5" by 5" square tubes having a wall thickness of approximately ⅜ inches. These dimensions are provided by way of example only. Those skilled in the art will realize that there are any number of different cross sectional areas, wall thicknesses, and other structures that can provide sufficient structural rigidity to support the weight of rail panel 10.

Figure 5:
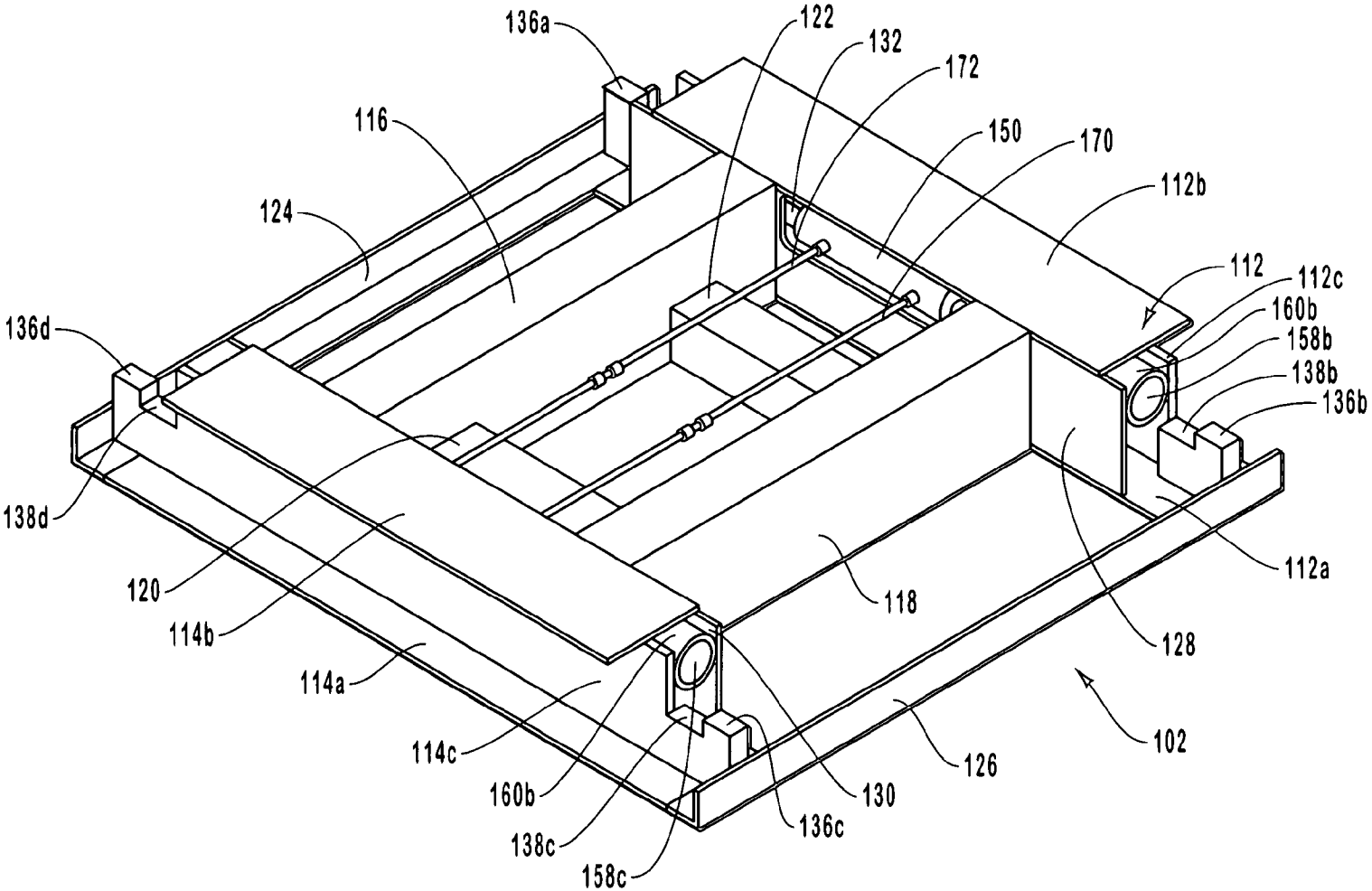
FIG. 5 illustrates a perspective view of the underside of the rail panel grabber assembly of FIG. 2.

With continued reference to FIGS. 3 and 5, each "H" beam 112, 114 further includes a plate 128, 130, respectively (shown in phantom in FIG. 3), mounted towards the inside of the "H" beams 112, 114. Plate 128 is mounted on an inside of beam 112 between top flange 112*a* and bottom flange 112*b*. Plate 130 is mounted on an inside of beam 114 between top flange 114*a* and bottom flange 114*b*. Each plate 128, 130 includes an aperture 132, 134, respectively, that enables access to a hydraulic assembly 150, 152, respectively. Plates 128, 130 provide some protection for hydraulic assemblies 150, 152, which will be discussed in greater detail below. Apertures 132, 134 enable hydraulic lines to connect to hydraulic assemblies 150, 152, and enable convenient repair or replacement if necessary. The apertures also allow an operator to easily change the hydraulic lines feeding hydraulic assemblies 150, 152.

Figure 4A:
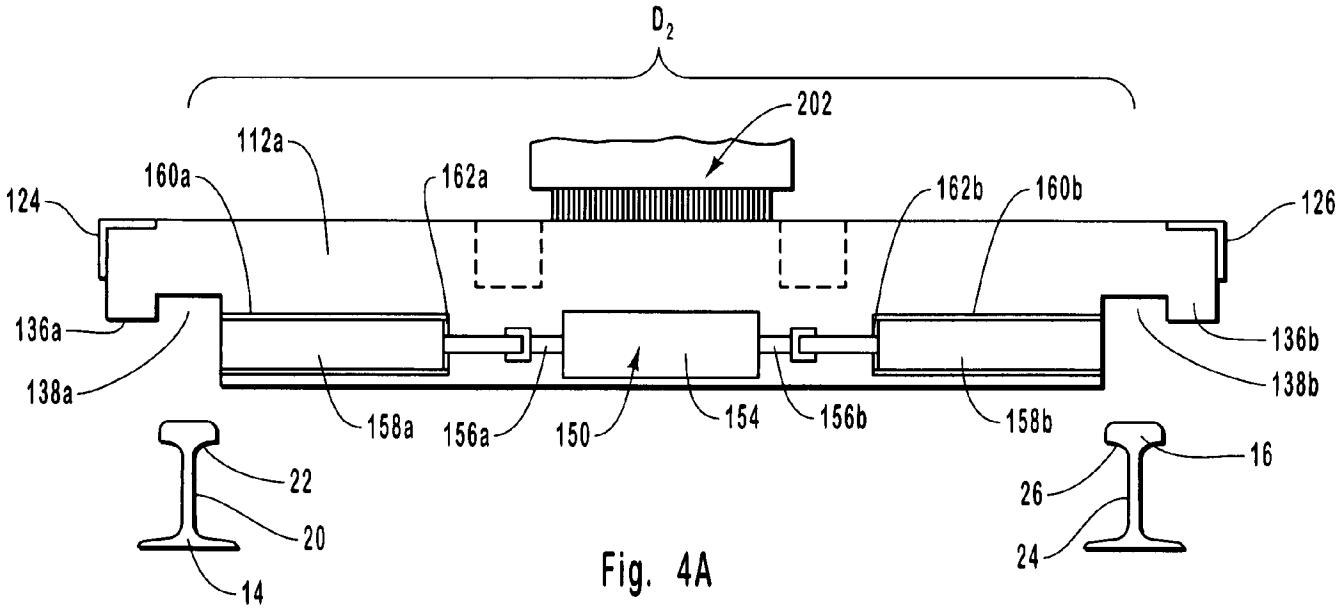
FIGS. 4A and 4B are detailed cutaway side views of the panel grabber assembly of FIG. 2 illustrating the mounting of the assembly on a rail panel and the operation of the hydraulic cylinder.
Figure 4B:
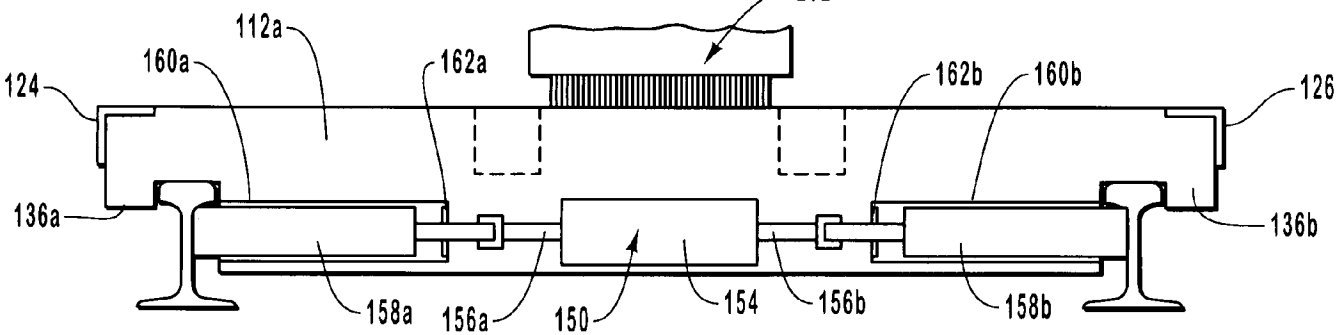

With reference to FIGS. 4A, 4B and 5, "H" beam 112 includes stop plates 136*a* and 136*b* located on opposing ends. Beam 114 further includes stop plates 136*c*, 136*d* located on opposing ends. Each stop plate 136 forms an outside boundary of a respective notch 138*a*-138*d* in beams 112, 114. These notches 138*a-d* are designed to accommodate the width of, by way of example and not limitation, heads 20, 30 of rails respectively, shown in FIG. 1. Additionally, the distance $D_2$ between notches on each beam 112, 114 is generally the same as the distance $D_1$ (approximately the gauge) between rails 14, 16 in rail panel 10. The width of notches 138*a-d* and the distance $D_2$ between the notches on each of beams 112, 114 are precisely measured to correspond with the rail head width and gauge for the panels that rail panel grabber assembly 100 will move. These specific measurements are calibrated depending on the rail width and gauge desired. All rail head widths and gauges, wherever found in the world, are contemplated to fall within the scope of the exemplary embodiments of the present invention.

Each stop plate 136*a-d* can be a metal plate approximately 2 inches thick. Stop plate 136*a-d* can be integral with or welded to respective beams 112, 114, and can be integral with or welded to first and second angle braces 124, 126, respectively. In one embodiment, each stop plate 136*a-d* can be welded to both the beams and the angle braces. The specific function of stop plates 136*a-d* will be discussed below.

In exemplary embodiments, all of the components of frame 110 are welded together to form a rigid structure. However, other methods of joining such components are also contemplated, such as the use of mechanical fasteners or other methods, as long as the completed frame provides sufficient structural rigidity to allow panel grabber 102 to lock onto rail panel 10.

In one exemplary embodiment, hydraulic assemblies 150, 152 are identical or substantially similar. However, any hydraulic assembly capable of generating the necessary force can be used in either "H" beam 112, 114. To avoid redundancy, the following discussion will focus on the structure of hydraulic assembly 150, keeping in mind that assembly 152 can have the same or similar structure. In those places where the specific structure of hydraulic assembly 152 is shown in the drawings, the letter designations "c" and "d" are used to label the parts that correspond to similar structure in hydraulic assembly 150.

With continued reference to FIGS. 3, 4A and 4B, hydraulic assembly 150 includes a hydraulic cylinder 154. In an exemplary embodiment, hydraulic cylinder 154 is not fixed within the passage defined by beam 114 and plate 130, but is free to move within the passage. Extending from hydraulic cylinder 154 is a pair of actuators 156*a*, 156*b*. Actuators 156*a* and 156*b* are connected to pins 158*a* and 158*b*, respectively. Each pin 158*a* 158*b* is constrained in a sliding relationship within a cylinder 160*a*, 160*b*. Within each cylinder 160*a*, 160*b* is a backstop 162*a*, 162*b* designed to prevent pins 158*a*, 158*b* from retracting too far towards hydraulic cylinder 154.

In an exemplary embodiment, pins 160*a*, 160*b* are made from 2⅜ inch diameter steel. Cylinders 160*a*, 160*b* are welded to frame 110 and can be made from 4.5 inch (outside) diameter steel having 1 inch thick walls, for example. In the embodiment, cylinders 160*a*, 160*b* are 13.5 inches long. Those skilled in the art will realize that other dimensions for pins 158*a*, 158*b* and cylinders 160*a*, 160*b* are also possible and are contemplated to fall within the scope of exemplary embodiments of the present invention.

With specific reference to FIG. 5, the underside of panel grabber 102 is shown. Hydraulic assembly 150 is visible through aperture 132 in plate 128. A pair of hydraulic lines 170, 172 powers hydraulic assemblies 150, 152. Line 170 is a high pressure line that actuates hydraulic assemblies 150, 152 to force pins 158*a-d*, into contact with the rails of rail panel 10 (see FIGS. 4A/4B). Line 172 is a high pressure line that actuates hydraulic assemblies 150, 152 to retract pins 158*a-d*, thus releasing rail panel 10 (see FIGS. 4A/4B). Additional details of the operation of rail panel grabber assembly 100 using hydraulic assemblies 150, 152 are discussed below.

Having outlined the basic structure of panel grabber 102, a brief discussion of rotator 202 is in order. In exemplary embodiments, rotator 202 is a commercially available, hydraulically actuated rotator assembly. However, those skilled in the art will realize that there are many other rotator assemblies that could be used. Any assembly that is capable of rotating rail panel 10 when it is suspended by excavator 106 is contemplated to be within the scope of exemplary embodiments of the present invention.

Figure 6:
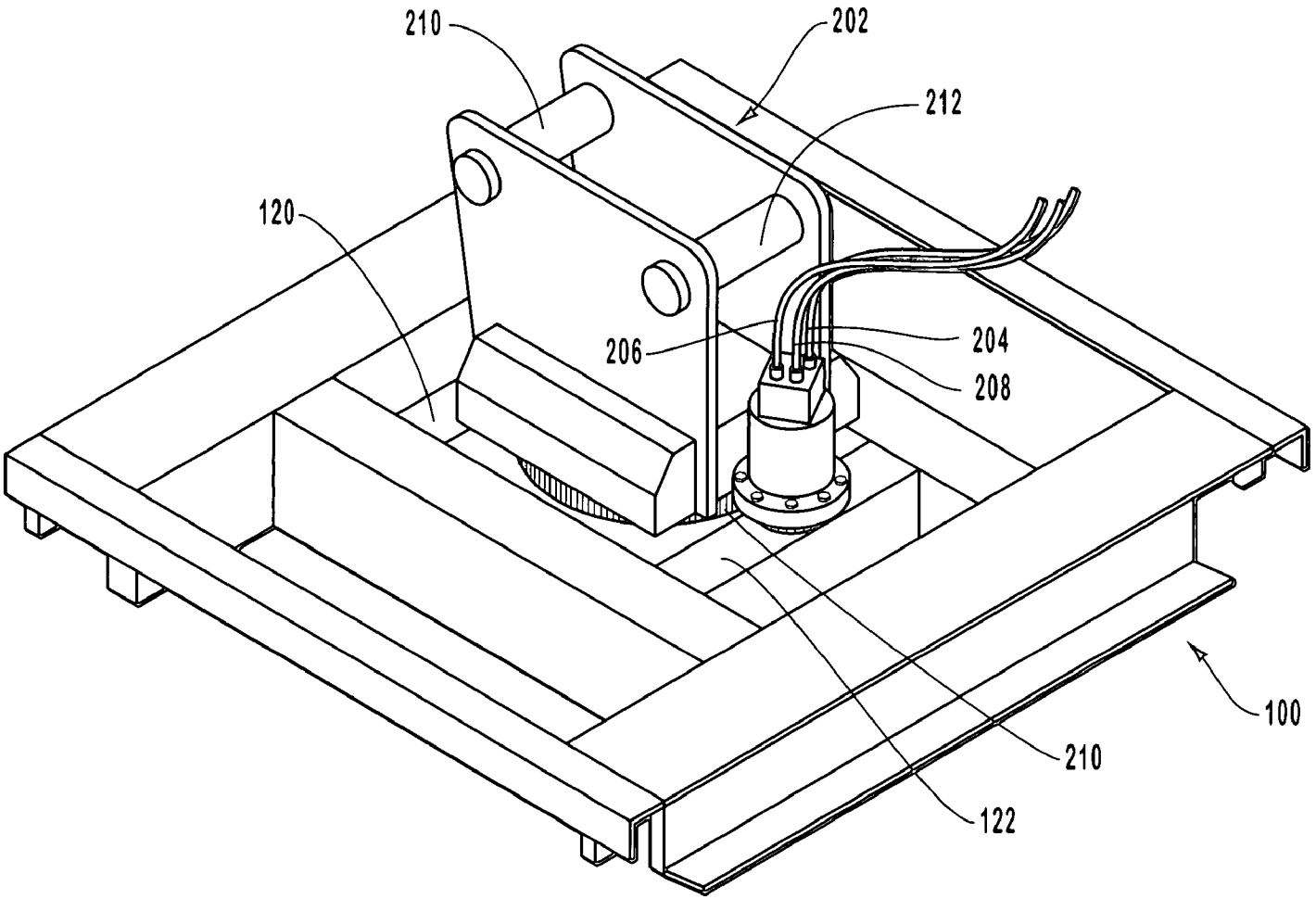
FIG. 6 is a top perspective view of the rail panel grabber assembly of FIG. 2 showing a rotator and certain hydraulic lines.

With reference to FIG. 6, rotator 202 includes high pressure hoses 204, 206 that enable rotator 202 to rotate rail panel 10 in either direction. This rotation is accomplished using a hydraulically actuated rack and pinion gear, which is shown partially as reference numeral 210. Additionally, there is a third hose (not shown) associated with rotator 202 that allows hydraulic fluid to drain from a reservoir (not shown). A high pressure hose 208 feeds high pressure hose 170 (FIG. 5) of panel grabber 102. Another high pressure hose (not shown) feeds high pressure hose 172 (FIG. 5) of panel grabber 102.

Rotator 202 can include a greater or lesser number of hydraulic hoses depending on the specific configuration of the rotator. For instance, in some embodiments, a drain hose is not required. In this exemplary embodiment, high pressure hoses 204, 206, and 208 are designed to use quick connectors for the connection to excavator 106. This allows the operator of excavator 106 to grab, pick up and manipulate rail panel 10 as needed or desired. However, any other method known to those of skill in the art for connecting the high pressure hoses to excavator 106 can also be used.

Figure 6A:
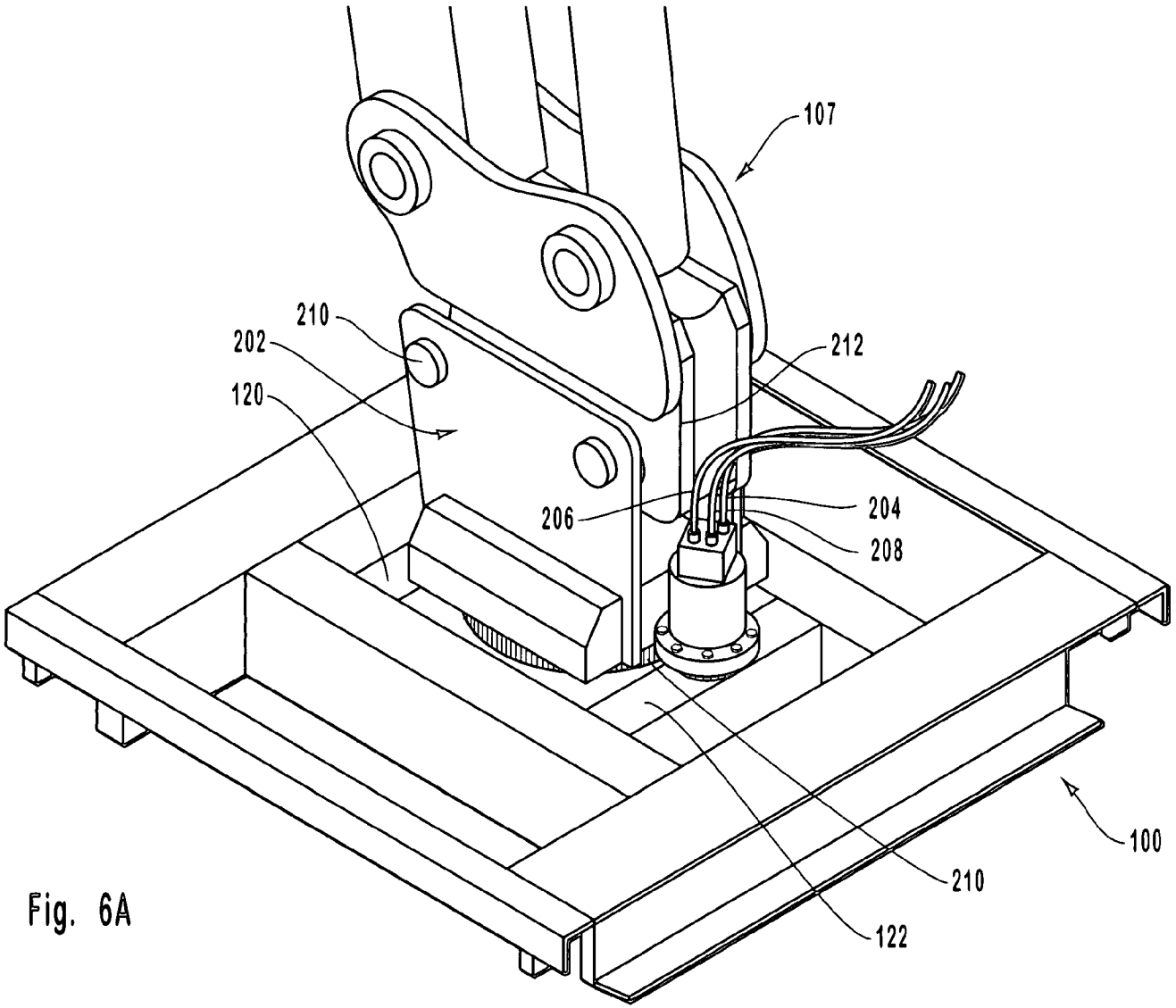
FIG. 6*a* shows a perspective view of the rail panel grabber assembly of FIG. 6 coupled to an excavator.

Rotator 202 also includes a pair of cross beams 210, 212 that facilitate the mechanical connection of rotator 202 to a piece of heavy equipment, as shown in FIG. 6*a*. For example, in one embodiment, excavator 106 has a mechanical linkage 107 that grasps both cross beams 210, 212. The mechanical linkage 107 may include, for example, a grabber coupler, such as an Esco Multi-Pin grabber coupler, which is available from Esco Corporation, Portland Oreg. One example of such a grabber coupler is Model # HTC 07102AL. Other pieces of heavy equipment can use the same or some other connection mechanism known in the art.

Figure 7:
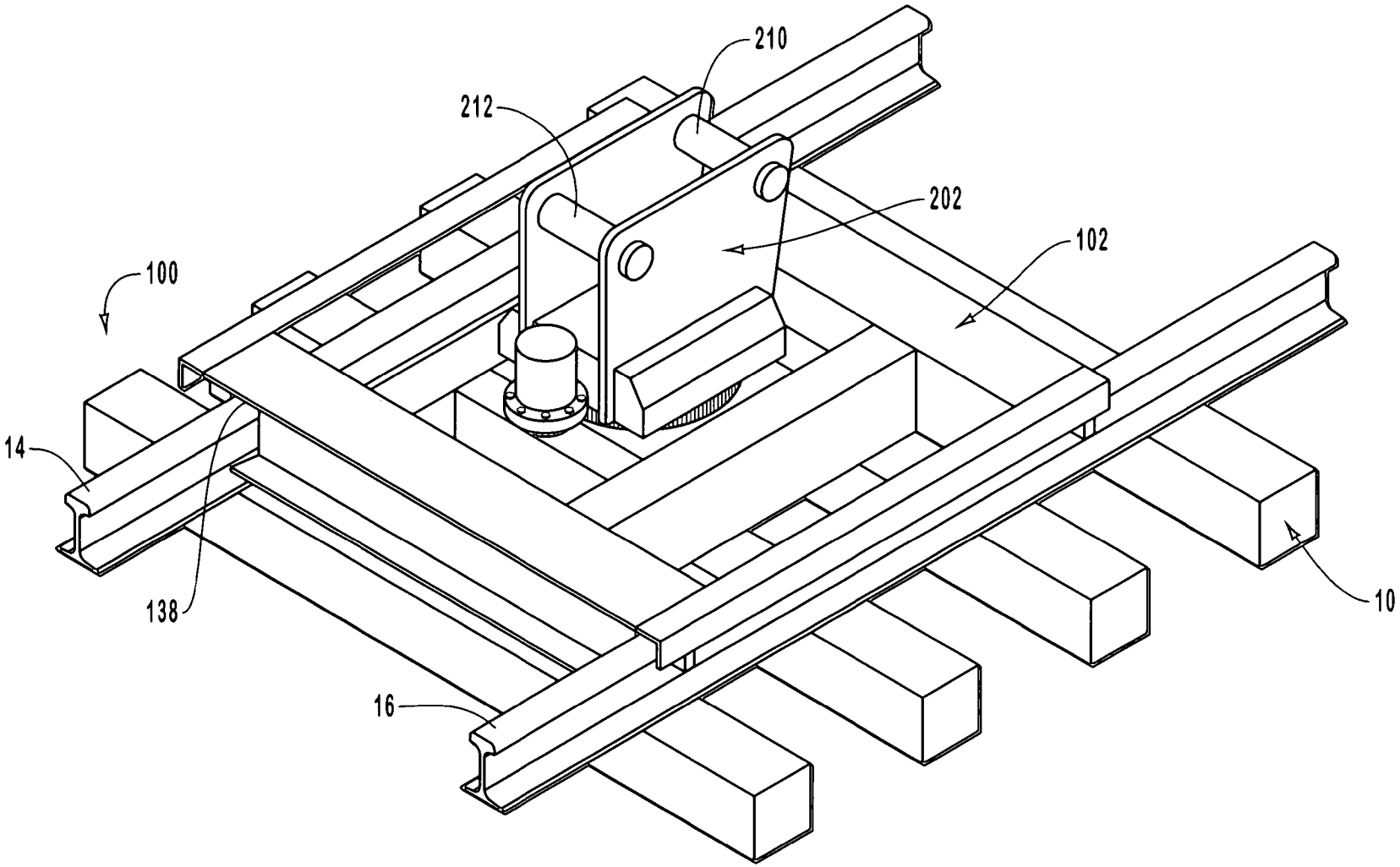
FIG. 7 illustrates a perspective view of the rail panel grabber assembly of FIG. 2 in an operational position mounted on a rail panel.

FIGS. 4A, 4B, 7 and 8 illustrate the basic operation of rail panel grabber assembly 100. FIG. 7 shows rail panel grabber assembly 100 in position on a rail panel 10. Panel grabber 102 is positioned on rails 14, 16 such that rails 14, 16 are engaged in respective slots 138*a-d*. The operator of excavator 106 can position rail panel grabber assembly 100 in this manner without any manual assistance. While rail panel 10 is shown positioned on the ground, this need not be the case. An operator of excavator 106 can position rail panel grabber assembly 100 on the top rail panel of a stack of rail panels sitting on a flatbed truck. The operator can then engage panel grabber 102, lift the top panel off of the truck, move it to wherever the panel is needed, and position the panel as desired. Additional help is not required.

The specific functioning of hydraulic assemblies 150, 152 in the process outlined above will be discussed with reference to FIGS. 4A and 4B. FIG. 4A shows a partial side view of part of panel grabber 102 in position above a rail 14. Note that pins 158*a*, 158*b* are in a retracted position as the panel grabber assembly is moved into position. In operation, all four pins will be positioned similarly, and discussion of the operation of a single pin, e.g. pin 158*a*, applies to all four pins 158*a-d*. Likewise, discussion of the operation of a single hydraulic assembly applies to the other hydraulic assembly.

In one embodiment, shown by way of example only in FIG. 4B, when the operator actuates hydraulic assemblies 150, 152, all of pins 158*a-d* extend at the same time. In this exemplary embodiment, a single high pressure hose 172 (FIG. 5) activates hydraulic assemblies 150, 152 to simultaneously move all four pins 158*a-d* into the extended position. Likewise, high pressure hose 170 activates hydraulic assemblies 150, 152 to simultaneously retract all four pins 158*a-d*. While this need not be the case, it is preferred in one embodiment as an added safety measure. All four pins will either be engaged or disengaged simultaneously. The operator of excavator 106 need not worry about one side of panel grabber 102 engaging, while the other side does not.

FIG. 4B shows a partial side view of part of panel grabber 102 in an engaged position on top of rail 14. Note that pins 158*a*, 158*b* are now in an extended position, such that pin 158*a* contacts inside surface 26 of body 22 of rail 14, and abuts lower inside surface 28 of head 20. Sufficient pressure is applied to all four pins to firmly fix rail panel 10 to rail panel grabber assembly 100. Stop plates 136*a-d* on the outside of rails 14, 16 prevent pins 158*a-d* from bending or otherwise distorting the rails. The weight of rail panel 10 is thus supported by the four engaged pins 158*a-d* held securely in frame 110. While one exemplary embodiment has the pins 158*a-d* engaging an inside surface of the rails, a similar system can be used to engage the outside of the rails. Systems that use hydraulic pressure, and other systems used to grasp and firmly hold the rails, are considered to be within the scope of exemplary embodiments of the present invention.

Figure 8:
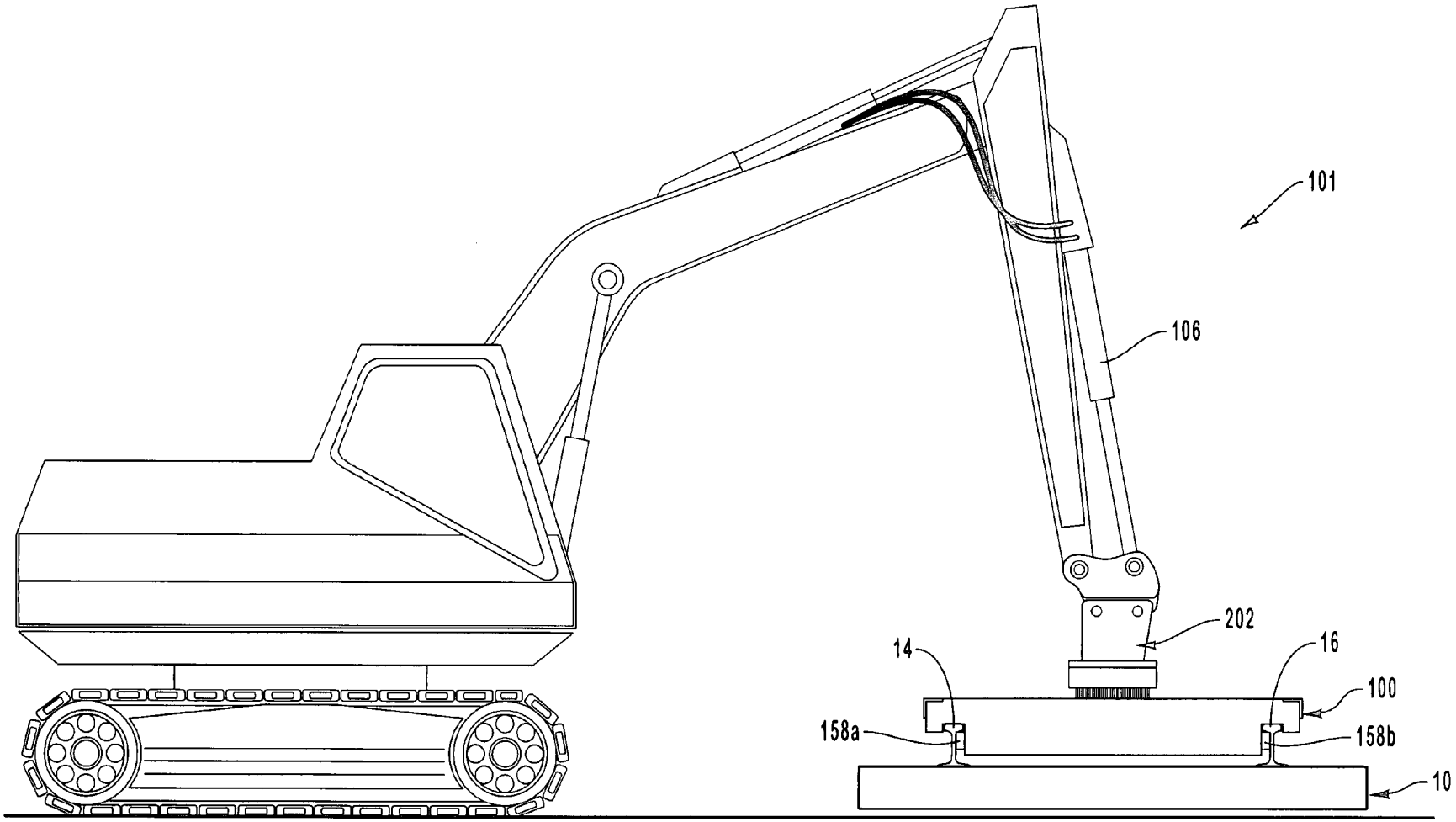
FIG. 8 illustrates a perspective view of the system of FIG. 2 with the rail panel grabber assembly and rail panel in an elevated position.

FIG. 8 shows excavator 106 holding rail panel 10 in a raised position. While in this position, the operator can rotate, twist, turn and otherwise manipulate rail panel 10 using rotator 202. The operator can also drive from the pickup site to wherever the rail panel is needed. Note that no personnel other that the operator of excavator 106 need have any contact with rail panel 10 to initially pick and move rail panel 10. No guide lines are required. When the operator reaches his destination, the operator can place the panel in its operational position with only minor assistance from a single guide person. It should also be noted that the operator of excavator 106 need not pick up rail panel 10 in the exact center. Off center operation is easily accomplished using the procedure outlined above, since rail panel 100 is hydraulically coupled to rail panel 10.

Rail panel grabber assembly 100 provides many advantages over the grabber of the prior art. First, the operator of excavator 106 can pick up the panels without assistance, while remaining safely within the cab of the excavator. It is not necessary to manually align the grabber and position it over the rails. Since exemplary embodiments of the present grabber fixedly couple to the rail panel, there is no need to specifically grab the panel in the center. This makes it even easier for the operator to grab and pick up panels unassisted. This also eliminates the need for guide ropes.

Another advantage of the exemplary embodiments of the present invention is that multiple personnel are not required to place the panels in their operational position on a rail bed. An excavator operator skilled in his art can place the panels either unassisted, or with the help of a single guide who can provide visual directions to the operator to facilitate exact placement. Finally, exemplary embodiments of the present invention allow the rail panels to be lifted, transported and operationally placed much quicker than typical systems. For example, in accordance with one exemplary embodiment, the panels can be lifted off of the flatbed, moved to the rail bed, and positioned in about one fourth the time it would take to accomplish the same tasks using typical systems. Similarly, at the panel construction facility, the panels can be loaded onto the flatbed trucks much more quickly and safely.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device for grabbing and holding a rail panel, the rail panel having a first and a second spaced apart rail, the first rail being parallel to and linked to the second rail, the grabbing device comprising:

a frame configured to be mounted on a rail panel, the rail panel having a first and a second spaced apart rail, the first rail being parallel to and linked to the second rail; and a plurality of moveable elements coupled to said frame, said grabbing device being configured such that the frame can be mounted on the rail panel with the plurality of moveable elements located between the first rail and the second rail, said moveable elements being configured to move outwardly from a retracted position to an extended position in order to contact respective first and second parallel rails;

wherein, when said frame is mounted on the rail panel and said plurality of moveable elements move outwardly from the retracted position to the extended position so as to contact respective first and second parallel rails, said grabbing device is fixed to the rail panel such that the rail panel is held by the grabbing device and is lifted by lifting the grabbing device.

2. The device of claim 1, further comprising a rotator connected to said frame, the rotator configured to rotate the rail panel when the rail panel is fixed to the grabbing device.

3. The device of claim 1, wherein said plurality of moveable elements comprises a first pair of moveable elements located at a first end of the frame and a second pair of moveable elements located at a second end of the frame, and further comprising a first mechanism coupled to the frame and the first pair of moveable elements for actuating the first pair of moveable elements and a second mechanism coupled to the frame and the second pair of moveable elements for actuating the second pair of moveable elements.

4. The device of claim 1, wherein said frame has notches sized and configured such that the first and second rails fit within respective notches when said frame is in contact with the first and second rails.

5. The device of claim 1, wherein said moveable elements comprise:

a first pair of pins, the first pair of pins being moveably connected to the frame; and a second pair of pins, the second pair of pins being moveably connected to the frame;

wherein, when said first and second pair of pins are moved by a mechanism coupled to the frame for moving said pins, said first pair of pins contact an inside surface of each of the first and second rails and said second pair of pins contact an inside surface of each of the first and second rails, thus fixing said frame to the rails.

6. The device of claim 5, wherein said mechanism for moving said pins comprises (i) a first hydraulic assembly coupled to the frame and to said first pair of pins and (ii) a second hydraulic assembly coupled to the frame and to said second pair of pins.

7. The device of claim 5, wherein the rail panel has a length, and wherein the first pair of pins are situated so as to contact a first location on the length of the rail panel, and the second pair of pins are situated so as to contact a second location on the length of the rail panel, the second location being different from the first.

8. The device of claim 1, further comprising a piece of equipment capable of lifting and transporting said device when said device is fixed to the rail panel.

9. The device of claim 8, wherein said piece of equipment has an operator, said operator being able to attach said device to the rail panel, lift the rail panel, and transport the rail panel without additional human assistance.

10. The device of claim 9, wherein said device can be attached to the rail panel at a point offset from a center of the panel.

11. A device as recited in claim 1, wherein said moveable elements comprise a first pair of pins and a second pair of pins.

12. A device as recited in claim 1, further comprising a mechanism coupled to said frame for moving said moveable elements with respect to said frame.

13. The device of claim 12, wherein said mechanism comprises a hydraulic assembly.

14. A modular device for grabbing and moving a rail panel, the rail panel having a first and a second spaced apart rail, the first rail being parallel to and linked to the second rail, the device comprising:

a frame configured to be mounted on a rail panel, the rail panel having a first and second spaced apart rail, the first rail being parallel to and linked to the second rail;

a first plurality of hydraulically operated elements coupled to said frame said first plurality of hydraulically operated elements comprising a first element coupled to one side of said frame and a second element coupled to an opposing side of said frame;

a second plurality of hydraulically operated elements coupled to the frame at a different location from the first plurality of hydraulically operated elements, said second plurality of hydraulically operated elements comprising a third element coupled to said one side of said frame and a fourth element coupled to said opposing side of said frame; and first and second hydraulic assemblies coupled to said frame for actuating respective first and second pluralities of hydraulically operated elements, wherein, when said hydraulically operated elements are actuated, said first and second pluralities of hydraulically operated elements contact respective first and second rails of the rail panel at different locations along the length of the rail panel, such that the modular device is fixed to the first and second rails.

15. The device of claim 14, further comprising a rotator coupled to said frame, wherein said rotator is hydraulically operated.

16. The device of claim 14, wherein said frame has notches sized and configured such that the first rail fits within respective notches and the second rail fits within respective notches when said frame is in contact with the first and second rails.

17. The device of claim 14, wherein said hydraulically operated elements are pins.

18. The device of claim 17, wherein said piece of equipment has an operator, said operator being able to attach said device to the rail panel, lift the rail panel, and transport the rail panel without additional human assistance.

19. The device of claim 18, wherein said device can be attached to the rail panel at a point offset from a center of the panel.

20. A device as recited in claim 14, wherein said first plurality of hydraulically operated elements comprises a first plurality of pins, said second plurality of hydraulically operated elements comprises a second pair of pins, and wherein said first and second hydraulic assemblies comprise first and second hydraulic cylinders, respectively, wherein, upon actuation, said first hydraulic cylinder forces said first pair of pins into contact with an inside surface of each of the first and second rails, and said second hydraulic cylinder forces said second pair of pins into contact with an inside surface of each of the first and second rails, thereby fixing said frame to the rails.

21. A system for lifting and transporting a rail panel, the rail panel having a first and a second spaced apart rail, the first rail being parallel to and linked to the second rail, wherein each rail is attached to a plurality of ties, the system comprising:

a frame configured to be mounted on a rail panel, the rail panel having a first and a second spaced apart rail, the first rail being parallel to and linked to the second rail;

a plurality of hydraulically operated pins coupled to said frame at different locations on the frame such that when said hydraulically operated pins are actuated, said frame is fixed to the rail panel, wherein the pins contact respective first and second rails of the rail panel at different locations along the length of the rail panel; and a piece of equipment capable of lifting and transporting said frame while said frame is fixed to said rails.

22. The system of claim 21, wherein said piece of equipment provides hydraulic power to said hydraulically operated pins.

23. The system of claim 21, farther comprising a rotator connected to said frame, wherein said piece of equipment provides hydraulic power to said hydraulically operated pins and to said rotator.

24. The system of claim 21, wherein said frame has notches sized and configured such that the first and second rails fit within respective notches when said frame is in contact with the first and second rails.

25. The system of claim 21, furthering comprising:

a first hydraulic assembly located at a first end of said frame, said first hydraulic assembly being connected to a first pair of said pins; and a second hydraulic assembly located at a second end of said frame, said second hydraulic assembly being connected to a second pair of said pins;

wherein, upon actuation, said first hydraulic assembly forces said first pair of pins into contact with an inside surface of each of the first and second rails and said second hydraulic assembly forces said second pair of pins into contact with an inside surface of each of the first and second rails, thus fixing said frame to the rails.

26. The system of claim 25, wherein said pins comprise metal having a diameter of at least 2 inches.

27. The system of claim 25, wherein said piece of equipment has an operator, said operator being able to attach said device to the rail panel, lift the rail panel, and transport the rail panel without additional human assistance.

28. The system of claim 27, wherein said device can be attached to the rail panel at a point offset from a center of the panel.

29. A device for grabbing and moving a rail panel, the rail panel having first and second spaced apart rails, the first rail being parallel to and linked to the second rail, the device comprising:

a frame configured to be mounted on a rail panel, the rail panel having a first and a second spaced apart rail, the first rail being parallel to the second rail, the frame being configured to receive portions of the first and second parallel rails in respective portions of the frame, wherein the frame is capable of being mounted on the rails; and a first plurality of elements moveably coupled to a first end of said frame;

a second plurality of elements moveably coupled to a second end of said frame;

a first mechanism coupled to the first plurality of elements and the frame for actuating the first plurality of elements; and a second mechanism coupled to the second plurality of elements and the frame for actuating the second plurality of elements, each of the first and second plurality of elements configured to move outwardly in order to contact respective inside surfaces of the parallel rails of the rail panel such that, when said elements contact the parallel rails, the parallel rails are held by the device.

30. The device of claim 29, wherein said frame has notches sized and configured such that the first and second rails fit within said notches when said frame is mounted on the first and second rails and further wherein said first and second plurality of elements are configured to abut lower surfaces of heads on the first and second rails.

31. The device of claim 30, wherein said first mechanism comprises a first hydraulic assembly and said second mechanism comprises a second hydraulic assembly and wherein said elements comprise:

a first pair of pins, the first pair of pins being connected to the first hydraulic assembly; and a second pair of pins, the second pair of pins being connected to the second hydraulic assembly;

wherein, when said hydraulic assemblies are actuated, said first hydraulic assembly forces said first pair of pins into contact with each of the first and second rails, and said second hydraulic assembly forces said second pair of pins into contact with each of the first and second rails, thus fixing said frame to the rails.

32. The device of claim 29, further comprising a piece of equipment capable of lifting and moving said frame when said frame is attached to the rails, and wherein said piece of equipment has an operator, said operator being able to attach said device to the rail panel, lift the rail panel, and transport the rail panel without additional human assistance.

33. A method for grabbing and transporting a rail panel, the rail panel having first and second spaced-apart rails, the first rail being parallel to the second rail, the method comprising:

mounting a device having a frame on the rail panel;

moving a plurality of elements coupled to said frame outwardly in order to contact respective first and second rails, such that when said plurality of elements move outwardly, said device becomes fixed to the first and second rails; and lifting the rail panel by lifting the device.

34. The method of claim 33, wherein said frame has notches that are sized and configured such that the first and second rails fit within respective notches when said frame is in contact with the first and second rails.

35. The method of claim 33, wherein said moveable elements comprise pins that selectively extend outwardly from the frame in order to contact respective first and second parallel rails.

36. The method of claim 33, wherein a mechanism for moving said elements outwardly comprises a first hydraulic assembly coupled to the frame and to a first plurality of moveable elements coupled to said frame.

37. The method of claim 36, wherein said mechanism for moving said elements further comprises a second hydraulic assembly coupled to the frame and to a second plurality of moveable elements coupled to said frame.

38. A device for grabbing a rail panel, the rail panel having a length, the rail panel comprising a first and a second spaced apart rail, the first rail being parallel to and linked to the second rail, the grabbing device comprising:

a frame configured to be mounted on the rail panel; and a plurality of moveable elements coupled to said frame, said moveable elements being configured to move outwardly in order to contact respective first and second parallel rails of the rail panel, wherein a first plurality of the moveable elements are located so as to contact a first location on the length of the rail panel, and a second plurality of the moveable elements are located so as to contact a second location on the length of the rail panel, the second location being different from the first location, wherein when said first and second plurality of moveable elements move outwardly, said device fixedly couples to the first and second rails such that the first and second rails are held by the device.

39. The device of claim 38, wherein the first and second plurality of moveable elements are each a plurality of hydraulically operated pins.

40. The device of claim 39, wherein the plurality of hydraulically operated pins comprise a first pair of pins and a second pair of pins, wherein the first pair of pins contact the first location on the length of the rail panel, and the second pair of pins contact the second location on the length of the rail panel.

41. The device of claim 40, further comprising a first hydraulic assembly coupled to the frame for moving the first pair of pins and a second hydraulic assembly coupled to the frame for moving the second pair of pins.

42. The device of claim 38, wherein the frame has a first and a second spaced apart beam, the first beam being parallel to the second beam.

43. A device for grabbing a rail panel, the rail panel comprising a first and a second spaced apart rail, the first rail being parallel to and linked to the second rail, the grabbing device comprising:

a frame configured to be mounted on the rail panel; and a plurality of moveable elements coupled to said frame, said moveable elements being configured to move and apply a pressure toward respective first and second parallel rails of the rail panel; and a plurality of stop plates coupled to said frame and configured to oppose the pressure from said plurality of moveable elements such that the first and second rails are selectively held between respective movable elements and respective stop plates.

* * * * *

UNITED STATES PATENT AND TRADEMARK OFFICE

CERTIFICATE OF CORRECTION

PATENT NO. : 7,287,476 B2 
APPLICATION NO. : 10/798052
DATED : October 30, 2007
INVENTOR(S) : Ernest Bruce Durbano It is certified that error appears in the above-identified patent and that said Letters Patent is hereby corrected as shown below:

Drawings

Delete figure 6 and substitute figure 6 below therefor

Sheet 6, replace Fig. 6 with the figure depicted herein below, wherein the second instance of reference "210" to the rack and pinion gear has been changed to --211--

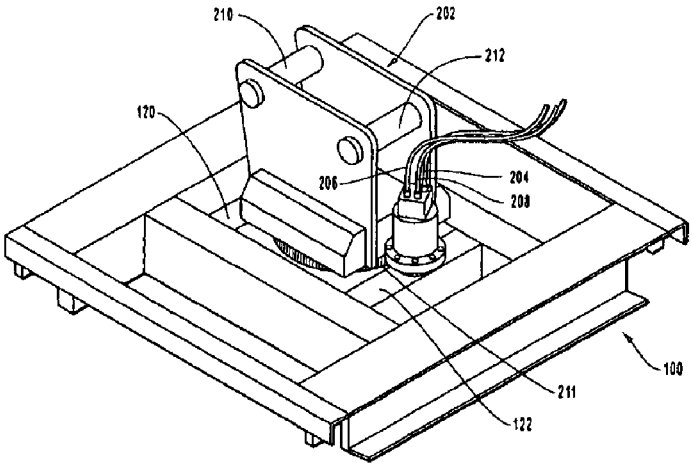

Fig. 6

Delete figure 6a and substitute figure 6a below therefor

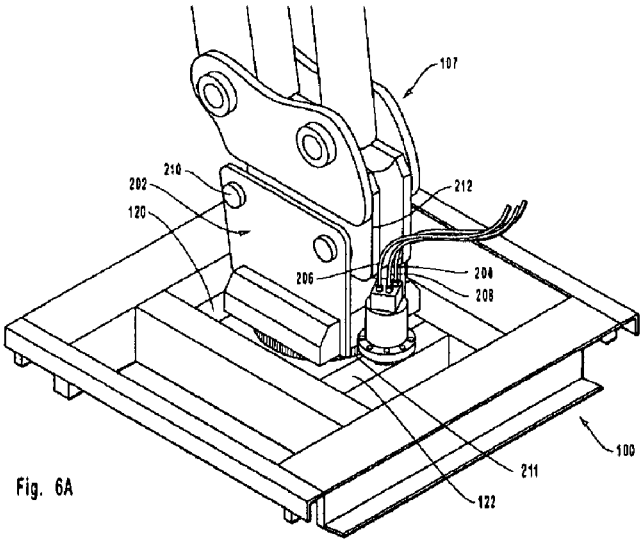

Fig. 6A

Column 3
Line 47, change "II" to --H--

Column 5
Line 30, change "114" to --112--
Line 30, change "130" to --128--

Column 6
Line 7, change "210" to --211--
Line 63, change "172" to --170--
Line 66, change "170" to --172--

Column 10
Line 32, change "farther" to --further--

Signed and Sealed this

Ninth Day of February, 2010

David J. Kappos

David J. Kappos
*Director of the United States Patent and Trademark Office*